United States Patent [19]

Watanabe

[11] 4,079,557

[45] Mar. 21, 1978

[54] STAY ANCHOR AND METHOD FOR DRIVING THE SAME

[76] Inventor: Hikoitsu Watanabe, No. 5-13, 1-chome Ehara-cho, Nakano, Tokyo, Japan

[21] Appl. No.: 734,819

[22] Filed: Oct. 22, 1976

[30] Foreign Application Priority Data

May 31, 1976 Japan ..... 51-62368

[51] Int. Cl.[2] ..... E02D 5/80

[52] U.S. Cl. ..... 52/164; 52/742

[58] Field of Search ..... 52/162, 163, 164, 158, 52/159, 160, 161, 742

[56] References Cited

U.S. PATENT DOCUMENTS

| | | | |
|---|---|---|---|
| 912,018 | 2/1909 | McNutt | 52/164 |
| 972,306 | 10/1910 | Wilcox | 52/163 |
| 991,525 | 5/1911 | McGreevey | 52/163 |
| 1,598,407 | 8/1926 | Tomkinson | 52/164 |
| 1,600,209 | 9/1926 | Tomkinson | 52/162 |
| 3,276,173 | 10/1966 | Bowman | 52/164 |

*Primary Examiner*—John E. Murtagh
*Attorney, Agent, or Firm*—Saul Jecies

[57] ABSTRACT

The present invention discloses a stay anchor and a method for driving it into the soil. The stay anchor includes a pair of cutting members pivoted with each other through a pair of connecting plates and each comprising an arcuately curved resisting plate and a stabilizing plate extended from the inner major surface of the resisting plate at right angles thereto. A driving device is also provided for engagement with the upper end of the stabilizing plate to exert the driving impacts thereto. When driven, the pair of cutting members are driven into the soil along a curved path due to the curved resisting plates and opened or angularly spaced apart from each other with the curved resisting plates bearing against the undisturbed soil so that excellent holding power may be developed.

5 Claims, 11 Drawing Figures

STAY ANCHOR AND METHOD FOR DRIVING THE SAME

BACKGROUND OF THE INVENTION

The present invention relates to the techniques for setting stay anchors and more particularly a stay anchor and a method for driving the same.

In general, two fundamental requirements are imposed on stay anchors which are set in the soil for supporting and steadying a structure. One requirement is that a stay anchor may be driven into the soil in a simple manner, and the other requirement, that after having been set, it bears against the undisturbed soil with as large a contact area as practicable so as to develop sufficiently greater holding power.

So far various stay anchors have been invented and demonstrated, but almost all of them are of the type which is straightly driven into the soil so that sufficiently high holding power cannot be developed. There has been devised and demonstrated a stay anchor of the type which has its lower members extended after the stay anchor has been driven into the soil a predetermined depth so that the bearing area may be increased and consequently satisfactory holding power may be developed. However, th anchors of this type are complex in construction as well as in driving. Therefore there has been a strong demand for a stay anchor which is simple in construction as well as in driving yet capable of developing sufficiently high holding power.

SUMMARY OF THE INVENTION

In view of the above, one of the objects of the present invention is to provide a method for driving a stay anchor into the soil so that satisfactory holding power may be developed.

Another object of the present invention is to provide a stay anchor which is simple in construction yet capable of developing greater holding power.

A further object of the present invention is to provide a stay anchor which may develop excellent holding power and which may arbitarily adjust its holding power as needs demand.

A further object of the present invention is to provide a device for driving the stay anchors of the types described into the soil in a simple manner.

To the above and other ends, the present invention provides a method comprising the steps of preparing a pair of cutting members which have the upper ends pivoted with each other and each of which has a resisting plate so arcuately curved as to determine the driving path in the soil of the cutting member, and driving the cutting members into the soil by exerting the driving impacts on the upper ends thereof so that they are driven along a curved path and then set into the soil. The pair of cutting members are pivoted with a pair of connecting members in back-to-back relationship so that they may be opened or moved away from each other when driven. The cutting members thus set in the soil is securely held by a control rod with the resisting plates firmly bearing against the undisturbed earth.

In order to ensure that the cutting members be driven along a designed curved path, the present invention further provides a device for driving the stay anchor. The lower end of the driving device is terminated into an engaging member adapted to swingably engage with an engaging portion at the upper end of each cutting member.

The above and other objects, features and advantages of the present invention will become more apparent from the following description of one preferred embodiment thereof taken in conjunction with the accompanying drawings.

DESCRIPTION OF THE PREFERRED EMBODIMENT

Figure 1:
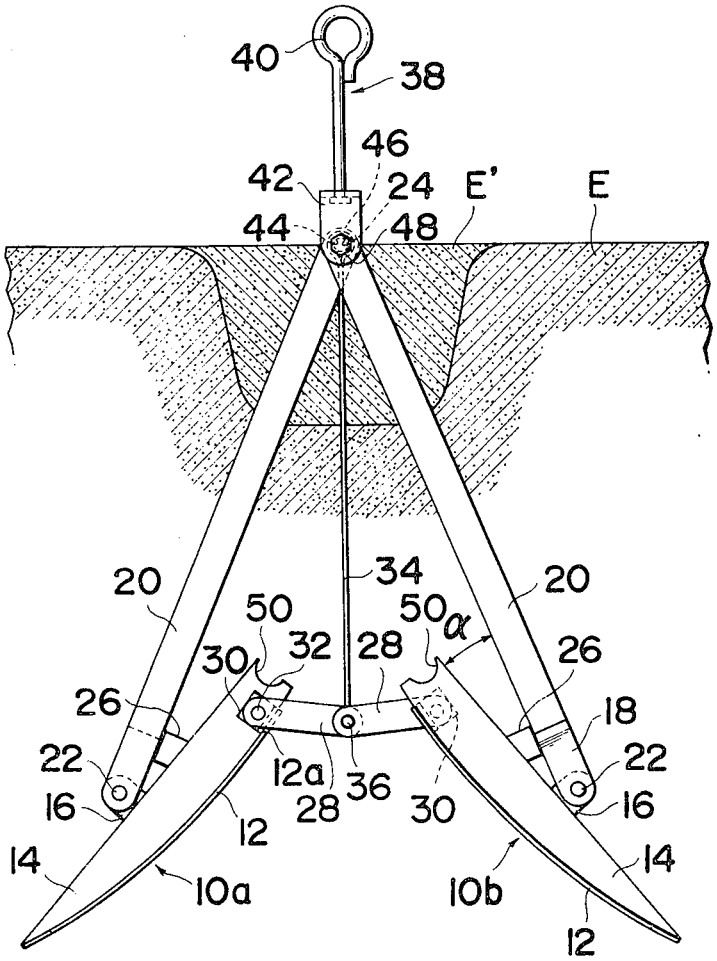
FIG. 1 is a front view of a stay anchor in accord with the present invention.
Figure 2:
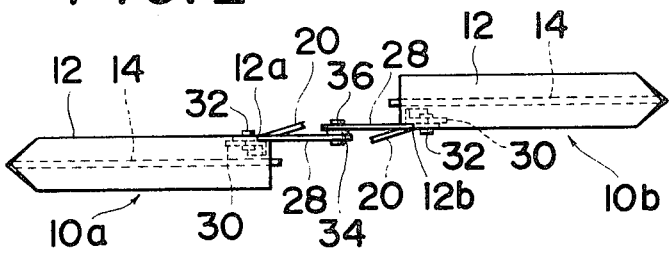
FIG. 2 is a bottom view thereof.
Figure 3:
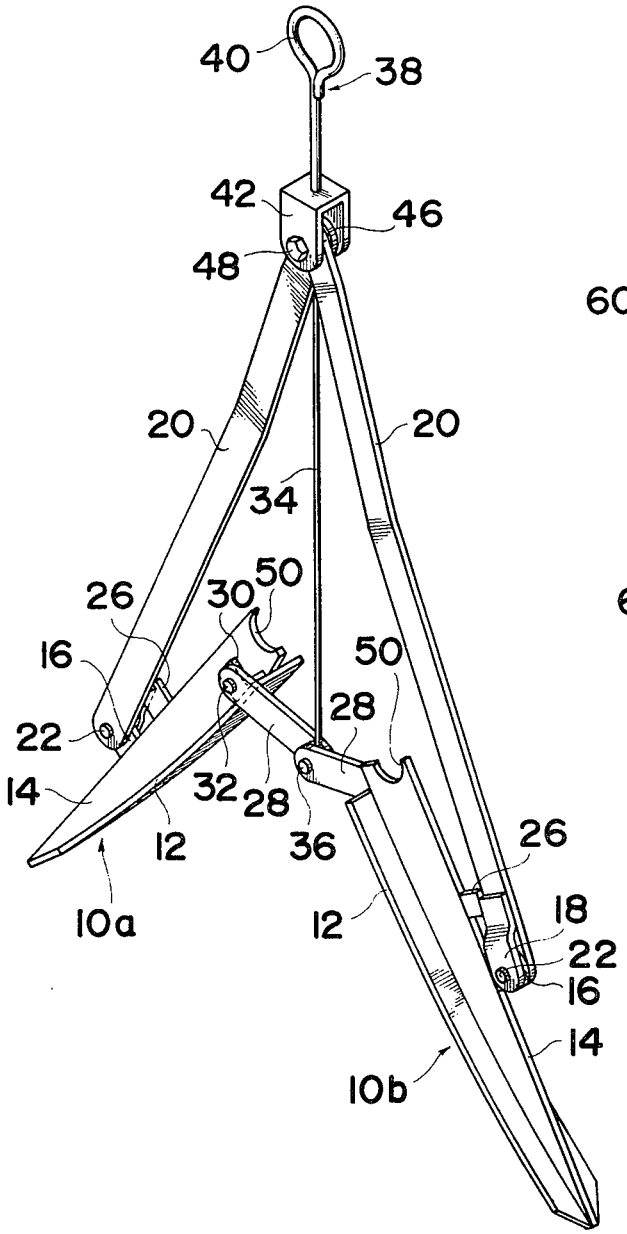
FIG. 3 is a perspective view thereof.

In FIGS. 1, 2 and 3 there is shown a stay anchor in accord with the present invention including a pair of cutting members 10*a* and 10*b* each comprising a resisting plate 12 which is arcuately curved with a relatively very gentle slope as best shown in FIG. 1 for determining a driving path of the cutting member 10*a* or 10*b* and a stabilizing plate 14 extended from the inner major surface of the resisting plate 12 at right angles thereto.

The lower end of each of a pair of tie or stay members or plates 20 is terminated into a bracket 18 which in turn is pivoted with a pivot pin 22 to a bracket 16 extended from a midpoint or a point adjacent thereto of the free side of the stabilizing plate 14, and the upper end of the tie or stay plate 20 is formed with a bolt insertion hole 24.

Extended also from the free side of the stabilizing plate 14 is a stop or angle restricting member 26 for engagement with both the tie or stay plate 20 and its bracket 18 so that the angle between the free side of the stabilizing plate 14 and the inner side of the tie or stay plate 20 may not become smaller than a predetermined angle $\alpha$.

The pair of cutting members 10*a* and 10*b* have their upper ends interconnected with each other with a pair of connecting plates 28. One end of each connecting plate 28 is pivoted with a pivot pin 32 to a bracket 30 extended from one of the major side surfaces of the stabilizing plate 14 at a position adjacent to the upper end thereof, and the other ends of the connecting plates 28 are pivoted together with a pin 36 to the lower end of the control rod 34. As best shown in FIG. 2, the connecting plate 28 is extended through a cutout portion 12*a* of the resisting plate 12 so that the angle of rotation of the connecting plate 28 is restricted.

A guy wire connecting member 38 with a ring 40 has its lower end securely fixed to the base of an inverted U-shaped bracket 42 to which are pivoted the upper ends of the pair of tie or stay plates 20 and the control rod 34 with a bolt 48 extended through holes 44 formed through the legs of the inverted U-shaped bracket 42, the holes 24 of the tie or stay plates 20 and a ring 46 at the upper end of the control rod 34.

The upper free side of the stabilizing plate 14 is formed with an arcuate engaging cutout portion 50 for engagement with an anchor driving device 60 to be described in detail hereinafter.

The pair of cutting members 10*a* and 10*b* are angularly spaced apart from each other as best shown in FIG. 2 so that they will not interfer with each other when they are opened or closed.

Figure 4:
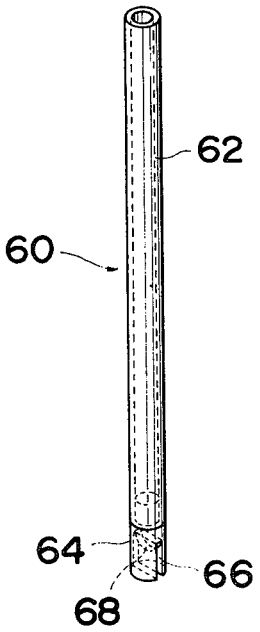
FIG. 4 is a perspective view of a driving device.

Next referring to FIG. 4, the driving device 60 will be described. It comprises a pipe 62 with a length depending upon a desired setting depth of the anchor and an engaging member 64 securely fixed to the lower end of the pipe 62 and formed with an engaging slot 66 into which is fitted the upper end of the stabilizing plate 14 and an arcuate projection 68 extended downwardly from the bottom of the engaging slot 66 for engagement with the arcuate cutout portion 50 of the stabilizing plate 44.

Next referring to FIGS. 5*a* through 5*e*, the method for driving the stay anchor with the above construction will be described.

In the first step, the bolt 48 is removed to release the pair of tie or stay plates 20 and the control rod 34 from the bracket 42 of the guy wire connecting member 38.

Figure 5A:
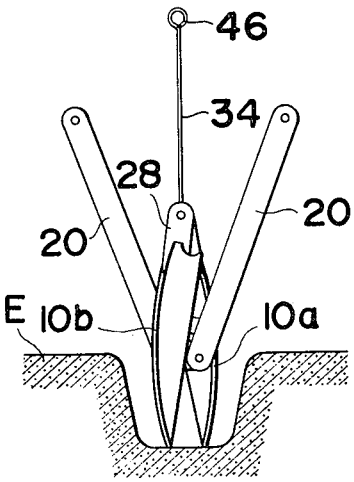
FIGS. 5 and 6 are views used for the explanation of the steps for driving the stay anchor into the soil.
Figure 5B:
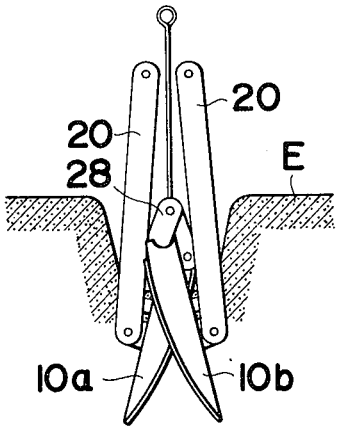
Figure 5C:
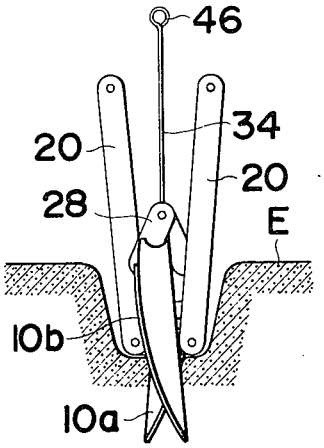
Figure 5D:
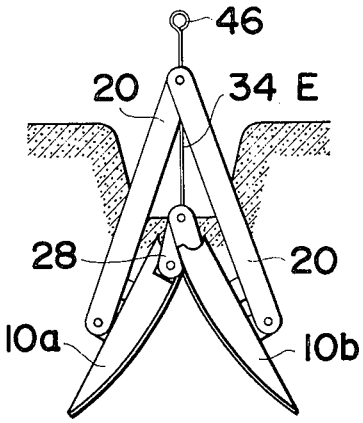
Figure 5E:
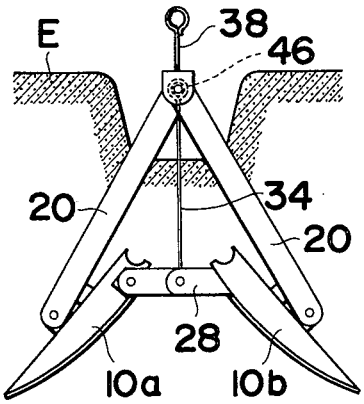
Figure 6A:
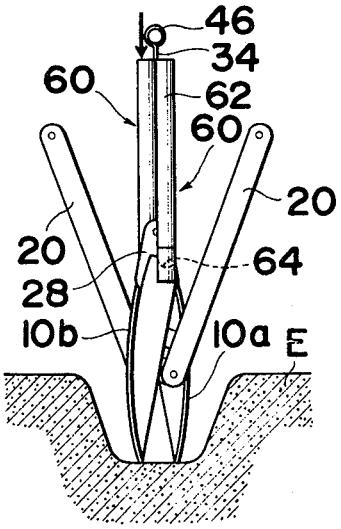
Figure 6B:
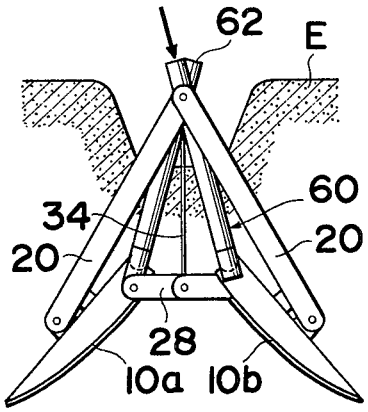

In the next step a hole with a suitable diameter and a depth is dug in the ground E as shown in FIG. 5*a*, and the stay anchor is placed upright in the hole with the cutting members 10*a* and 10*b* closed as shown in FIG. 5*a*. Next the engaging slot 64 of the driving device 60 is fitted over the upper end of each stabilizing plate 14 with the annular projection 68 engaged with the arcuate cutout portion 50 as shown in FIGS. 6*a* and 6*b*. By applying the driving impact to the top of the pipe 60 with a hammer or the like, the stay anchor is driven into the ground. More particularly, the cutting members 10*a* and 10*b* are gradually driven into the soil E, and because the resisting plate 14 is curved the cutting member 10*a* or 10*b* is driven into the soil along a curved path as shown in FIGS. 5*b*, 5*c* and 5*d* as the driving impacts are applied so that the pair of cutting members 10*a* and 10*b* are gradually spaced apart from each other. The cutting members 10*a* and 10*b* are driven into the soil until the connecting members 28 become straight as shown in FIG. 5*e*. Thereafter the upper ends of the pair of tie or stay plates 20 and the control rod 34 are joined again with the bolt 48 to the bracket 42; the hole is refilled with the soil; and a guy wire (not shown) is fastened to or extended through the ring 46.

When the pull is applied to the guy wire connecting member 38 of the anchor which has been driven into and set in the soil as shown in FIG. 1, the pull tends to pull out the cutting members 10*a* and 10*b* along the curved paths which they cut when they were driven into the gound, but the rotation of the connecting plates 28 is limited by the cutout portions 12*a* of the resisting plates 12, and the upward movement of the pivot 36 is prevented by the control rod 34 so that the cutting members 10*a* and 10*b* cannot be closed. Consequently the resisting plates 12 of the cutting members 10*a* and 10*b* firmly bear against the surrounding undisturbed soil so that excellent holding power may be developed against the pull.

Referring back to FIG. 5*a*, the cutting members 10*a* and 10*b* are preferably sufficiently spaced apart from each other in the upright position before they are driven into the soil, and then they cross each other as shown in FIGS. 5*b* and 5*c* as they are driven into the ground so that when they are finally driven they are angularly spaced apart from each other with a suitable angle therebetween.

So far the cutting members 10*a* and 10*b* have been described as being simultaneously driven, but it will be understood that they may be alternately driven until the connecting plates 28 become in line with each other.

Next the method for pulling the anchor out of the soil will be described. In the first step, the bolt 48 is removed to release the tie or stay plates 20 and the control rod 34 from the bracket 42, and in the next step the control rod 34 is pulled upwardly so that the cutting members 10*a* and 10*b* are pulled out.

As described above, in the anchor in accord with the present invention, the pair of cutting members 10*a* and 10*b* have the upper ends pivoted. through the connecting members 28 and have the curved resisting plates 12 so that the cutting members 10*a* and 10*b* may be driven into the soil along a curved path and opened or spaced apart from each other. The control rod 34 serves to firmly hold the cutting members 10*a* and 10*b* in the opened position so that excellent holding power or resisting force may be developed against a relatively greater pulling load.

Furthermore the cutting members 10*a* and 10*b* are automatically opened as they are driven into the soil so that the driving may be accomplished in a very simple manner and no special technique is required.

In addition, with the use of the driving device 60, the curved path which the cutting member 10*a* or 10*b* cut the soil when driven may be left undisturbed.

Thus the stay anchor and the method for driving the same in accordance with the present invention may permit the stay anchor in an efficient manner and develop excellent holding or resisting power.

It will be understood that the stops 26 and the brackets 16 may be formed integral with the stabilizing plates 14.

What is claimed is:

1. A stay anchor comprising a. a pair of cutting members each comprising
   an arcuately curved resisting plate, and
   a stabilizing plate extended from the inner major surface of said resisting plate at right angles thereto, b. a pair of connecting members having their one ends pivoted to each other and their other ends pivoted to the upper ends of the cutting members, c. a pair of tie or stay plates each having the lower end pivoted to the midpoint or point adjacent thereto of the free side of said stabilizing plate, d. a control rod having the lower end pivoted to said one ends of said pair of connecting plates, and e. a guy wire connecting member having the lower end releasably pivoted to the upper ends of said pair of tie or stay plates and the upper end of said control rod, said upper ends of said pair of tie or stay plates and the upper end of said control rod being released from each other when said guy wire connecting member is released therefrom.

2. A stay anchor as set forth in claim 1 further comprising a. each of said resisting plates being formed with a cutout portion through which is extended the connecting member so that the angle of rotation of said connecting plate about a pivot pin at one end thereof may be restricted, and b. a stop extended from the free end of each stabilizing plate, whereby the minimum angle between the cutting member and the tie or stay plate may be limited.

3. A stay anchor, comprising a pair of soil-cutting members each including an elongated resisting plate which is arcuately curved in longitudinal direction and has a convex and a concave major surface, and a stabilizing plate projecting from said concave major surface substantially normal thereto;

means pivotally connecting said resisting plates adjacent their trailing ends and with said concave sides facing towards each other;

means for driving said cutting members into the soil so that due to the soil resistance against said arcuately curved resisting plates the same pivot about their trailing ends in direction outwardly away from each other while penetrating the soil in paths which arcuately diverge in outward and downward direction;

said driving means including a length of pipe and an engaging member firmly joined to the lower end of said pipe and formed with a slot for engagement with the upper end of the respective stabilizing plate;

said engaging slot having an arcuate projection extending from the bottom thereof for engagement with an arcuate cutout portion formed at the upper end of the respective stabilizing plate.

4. A method of driving a stay anchor into the soil, comprising the steps of forming in the soil a depression;

preparing a stay anchor having a pair of cutting members each including an arcuately curved resisting plate and a stabilizing plate extended from the inner major surface of the respective resisting plate at right angles thereto, a pair of connecting members having their one ends pivoted to each other and their other ends pivoted to the upper ends of the cutting members, a pair of tie plates each having a lower end pivoted to the free side of the stabilizing plate adjacent the midpoint thereof, a control rod having a lower end pivoted to said one ends of said pair of connecting members, and a guy wire connecting member having a lower end releasably pivoted to the upper ends of said pair of tie plates and the upper end of of said control rod;

inserting the lower end portions of said cutting member into said depression so that they rest on undisturbed soil;

driving said pair of cutting members into the undisturbed soil along a curved path whereby, due to the presence of the curved resisting plates, they become gradually spread apart from each other; and holding said pair of cutting members apart with said control rod, so that holding or resisting power may be developed against an upwardly directed load acting upon the stay anchor.

5. A method as set forth in claim 4; and further comprising the step of withdrawing said cutting members from the soil when said anchor is no longer to be used, substantially along the same paths in which said cutting members were originally driven into the soil.

* * * * *